United States Patent [19]

Papazian

[11] Patent Number: 4,552,304

[45] Date of Patent: Nov. 12, 1985

[54] ELECTRONIC GAS VALVE PULSATOR

[76] Inventor: Arthur S. Papazian, 8010 Owensmouth Ave., Canoga Park, Calif. 91304

[21] Appl. No.: 592,073

[22] Filed: Mar. 22, 1984

[51] Int. Cl.[4] ..... F23N 5/20

[52] U.S. Cl. ..... 236/46 F; 236/DIG. 3

[58] Field of Search ..... 62/157, 231; 236/46 F, 236/46 R, DIG. 3; 165/12

[56] References Cited

U.S. PATENT DOCUMENTS

| | | | |
|---|---|---|---|
| 4,094,166 | 6/1978 | Jerles | 236/46 R X |
| 4,136,730 | 1/1979 | Kinsey | 62/231 X |
| 4,384,461 | 5/1983 | Kurtz | 62/231 X |
| 4,423,765 | 1/1984 | Hildebrand | 165/12 |
| 4,453,590 | 6/1984 | Holliday et al. | 236/46 F X |
| 4,485,966 | 12/1984 | Cartmell et al. | 62/231 X |

*Primary Examiner*—Harry Tanner

*Attorney, Agent, or Firm*—Edward D. C. Bartlett

[57] ABSTRACT

An electrically-operated gas valve in a gas furnace is pulsated between the fully-open and fully-closed position in response to a series of electrical pulses of selectable frequency and duty cycle. The pulses are generated by an electronic timer, which is user-adjustable to select a frequency and duty cycle from a range of frequencies and duty cycles. A switch in series with the gas valve alternately energizes and deenergizes the valve in response to the pulses, whereby the valve is fully-open when energized and fully-closed when deenergized.

5 Claims, 6 Drawing Figures

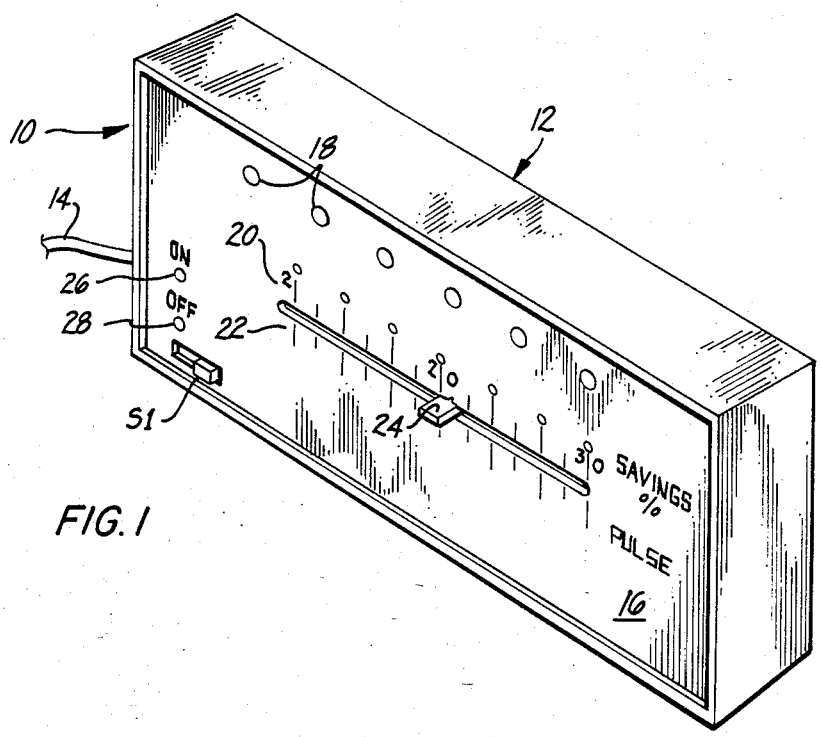
FIG. 1
FIG. 2
Prior Art
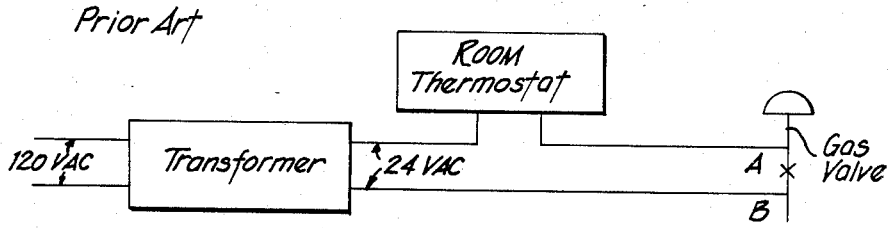
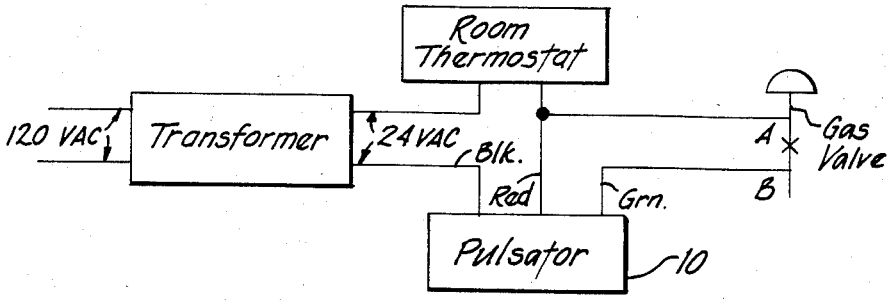
FIG. 3

ELECTRONIC GAS VALVE PULSATOR

BACKGROUND OF THE INVENTION

The present invention relates to gas furnaces having a thermostat and an electrically-operated gas valve responsive to the thermostat for controlling the flow of gas to the furnace.

Such heating systems are typically designed to handle the coldest temperature expected in a given geographic area. However, outside temperature seldom reaches the design low temperature. Therefore, most heating systems have more than enough capacity for actual outside temperatures.

In addition, most furnaces are designed to operate at full capacity from the time they start up to the time they shut down without taking into consideration the ability of the heat exchanger to absorb and radiate all the heat that is produced by the furnace in a given period of time. Any heat that is not absorbed or radiated by the plenum goes up the flue and is wasted.

It is an object of the present invention to reduce gas consumption in existing gas furnaces without sacrificing room comfort levels, by increasing the furnace efficiency.

By cycling and timing the "burn time" of the furnace, the heat exchanger will operate at its maximum absorption capacities, thereby improving overall heating efficiency.

SUMMARY OF THE INVENTION

Method and apparatus for pulsating an electrically operated gas furnace valve between the fully-open and fully-closed positions.

The apparatus comprises timing means for generating a series of electrical pulses having a preselected frequency and duty cycle, and switching means controlled by the timing means and connected in series with the valve for alternately energizing and deenergizing the valve in response to the electrical pulses, whereby the valve is in the fully-open position when energized and in the fully-closed position when deenergized.

A safety thermostat is connected in parallel with the switching means for energizing the gas valve independently of the switching means when the ambient temperature in a room being heated drops below a predetermined minimum value. This functions as a safety system to prevent the ambient temperature of the room from dropping too low, e.g. to freezing, in the event of failure of said electronic switch to energize the gas valve when a room thermostat controlling the heating of the room is closed.

The method comprises the steps of generating a series of electrical pulses having a preselected frequency and duty cycle, and alternately energizing and deenergizing said valve in response to said electrical pulses whereby said valve is in the fully-open position when energized and in the fully-closed position when deenergized.

For the purpose of illustrating the invention, there is shown in the drawings a form which is presently preferred; it being understood, however, that this invention is not limited to the precise arrangements and instrumentalities shown.

DESCRIPTION OF THE DRAWINGS

FIG. 1 is a perspective view of an apparatus in accordance with the present invention illustrating the user-accessible features of the invention.

FIG. 2 is a block diagram of typical furnace wiring known in the prior art.

FIG. 3 is a block diagram of the wiring of a typical gas furnace modified in accordance with the present invention.

DETAILED DESCRIPTION OF THE INVENTION

Figure 4:
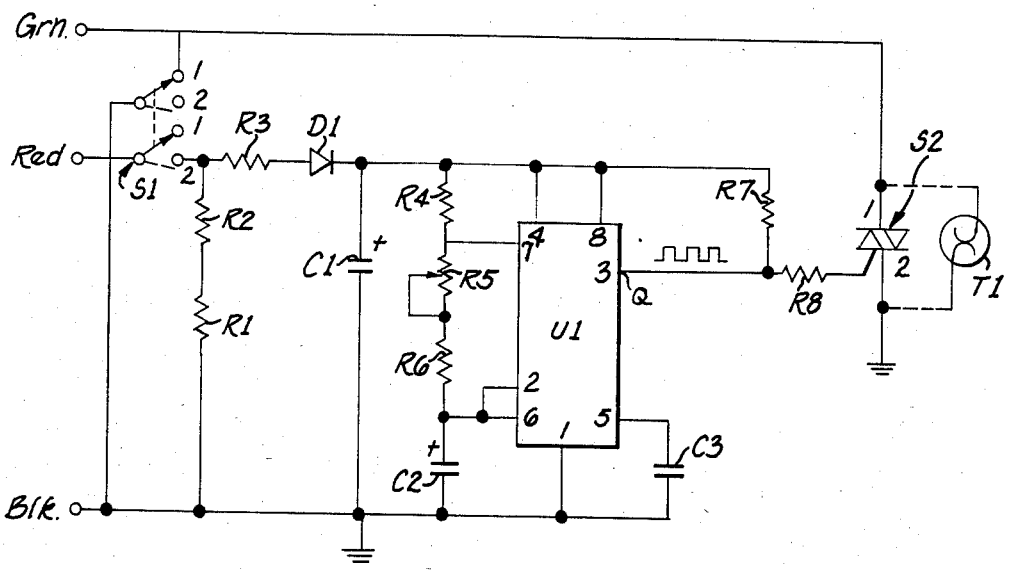
FIG. 4 is a schematic diagram of the electronic circuitry in accordance with the present invention.

Referring to the drawings, wherein like numerals indicate like elements, there is shown in FIG. 1 a perspective view of an electronic gas valve pulsator apparatus 10 in accordance with the present invention. Pulsator 10 comprises a housing 12 and associated wiring 14 for connecting the pulsator to the wiring of a gas furnace control. Pulsator 10 includes a face plate 16. A number of indicator lights or LEDs 18 are mounted on the plate 16 for indicating to the user that the pulsator 10 is in operation and functioning properly.

Face plate 16 also has two scales 20 (furnace efficiency) and 22 (pulse duration) which are used to select the frequency and duty cycle at which the gas furnace valve will be pulsated. The precise manner in which the gas valve is pulsated is described in greater detail below. A slide 24 is mounted behind face plate 16 and protrudes through an elongated opening in the face plate between scales 20 and 22. As illustrated in FIG. 1, the user can move slide 24 between a minimum setting at the extreme left and a maximum setting at the extreme right. The efficiency of the furnace is directly related to the duration of the pulses, as illustrated by the juxtaposition of scales 20 and 22 with respect to slide 24. The duty cycle of the gas valve, and hence the efficiency of the furnace, is continuously variable between the minimum and maximum settings.

A switch S1 is provided on face plate 16 to enable the user to operate the gas furnace either with or without the pulsator of the present invention. Indicator lights or LEDs 26 and 28 are also provided to give the user a visual indication of the on/off status of the pulsator.

The way in which the pulsator of the present invention is connected to a gas furnace can be readily understood by reference to FIGS. 2 and 3. FIG. 2 illustrates in block diagram form the wiring of a typical gas furnace having a thermostat and an electrically-operated gas valve. Normal 120 V ac house current is reduced to 24 V ac by the transformer. A room thermostat and the terminals of the electrically-operated gas valve are connected in series across the 24 V ac output of the transformer. The room thermostat is essentially a normally open switch. Thus, when room temperature is above the thermostat setting, the thermostat will be open, and the gas valve will be deenergized. The gas valve is in the fully-closed position when it is deenergized, preventing gas flow to the furnace. When the room temperature decreases, the thermostat will close, completing the circuit between the output of the transformer and the gas valve, thereby energizing the gas valve. When the gas valve is energized, it moves from its fully-closed position to the fully-open position, allowing gas to flow to the furnace for combustion.

The prior art gas furnace wiring illustrated in FIG. 2 is modified in accordance with the present invention as shown in FIG. 3. Pulsator 10, which will be described in greater detail below, is wired in series between the ground side of the transformer output and the B terminal of the gas valve. Power to the pulsator circuitry is provided by a connection to the room thermostat. Thus, pulsator 10 is inoperative when the thermostat is open, and will only operate when the thermostat is closed, i.e., the pulsator 10 will operate only when the furnace is to be fired.

The circuitry 30 of pulsator 10 is illustrated in schematic form in FIG. 4. The pulsator has three terminals, marked GRN, RED and BLK for convenience to correspond to the GRN, RED and BLK terminals illustrated in FIG. 3. That is, the terminals of pulsator 10 may be color coded to assist the user in connecting the pulsator to the furnace during installation. The choice of terminal colors is arbitrary.

Power is supplied to the pulsator 10 through the room thermostat via the RED terminal. The BLK terminal is connected to the ground side of the 24 V ac transformer and represents electrical ground. The GRN terminal is connected to the B terminal of the gas valve. A double pole, double throw switch S1 is connected to the GRN, RED and BLK terminals as shown in FIG. 4 to enable the user to operate the furnace with or without the pulsator. When the switch contacts are in position 1 as shown in solid lines in FIG. 4, the GRN and BLK terminals are shorted together, and the circuit is electrically equivalent to the conventional furnace wiring shown in FIG. 2. When the switch contacts are in position 2 as shown in phantom in FIG. 4, the pulsator 10 will be operative and the furnace wiring will be electrically as shown in FIG. 3. For the purposes of the following discussion, it will be assumed that switch S1 is in position 2.

When the room thermostat closes in response to decreasing room temperature, 24 V ac will be applied to the RED and BLK terminals. The 24 V ac is rectified by the network comprising resistors R1, R2 and R3, diode D1 and capacitor C1 to provide a dc voltage for the remainder of the pulsator circuit. The remainder of the pulsator circuit 30 comprises a timer U1 and a triac switch S2.

Timer U1 is preferably an electronic solid state timer, such as the type known as a NE555. The way in which electronic solid state timers such as U1 operate is well-understood by those skilled in the art, and need not be described here in detail. It is sufficient to note that timer U1 generates an output in the form of a series of pulses of selectable frequency and duty cycle. The frequency and duty cycle of the output pulses can be selected by a time constant network comprising fixed resistors R4 and R6, variable resistor R5 and capacitor C2. By adjusting the setting of resistor R5, the frequency and duty cycle of the output pulses can be varied. In practice, the movable contact of resistor R5 is mechanically coupled to slide 24 which protrudes through face plate 16 of the pulsator (see FIG. 1) so that the setting of resistor R5 may be manually adjusted by the user.

Switch S2 may be any suitable switch, such as a relay, but is preferably an electronic solid-state switch such as the triac shown in FIG. 4. As shown in FIG. 4, main terminal 1 of triac S2 is connected to the GRN terminal, and main terminal 2 of triac S2 is connected to the BLK terminal, or ground. The gate terminal of triac S2 is connected to the output of timer U1 via resistor R8. It will be apparent to those skilled in the art that triac S2 will be "gated", or switched on, by the positive-going edges of the output pulses from timer U1 (Q terminal), and switched off by the negative going edges of the pulses from timer U1. Thus, triac S2 functions as a switch which is closed during the duty cycle of the output pulses from timer U1 and open at all other times. When switch S2 is closed, the GRN and BLK terminals are shorted together, completing the circuit between the B terminal of the gas valve and the 24 volt transformer shown in FIG. 3, and the gas valve is thereby energized. When switch S2 is open, the gas valve is deenergized and assumes the closed position.

It will be appreciated that the "burn time" or duty cycle of the gas valve will correspond to the duty cycle of the output pulses from timer U1.

Figure 5:
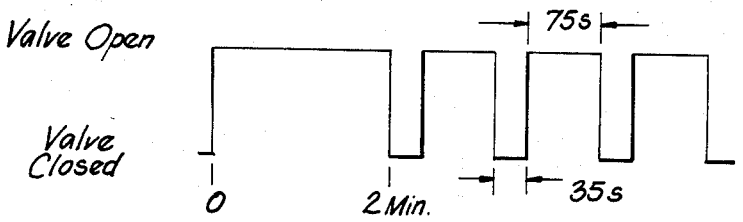
FIGS. 5(*a*) and 5(*b*) illustrate two typical timing wave forms generated by the timing means in accordance with the present invention.
Figure 5B:
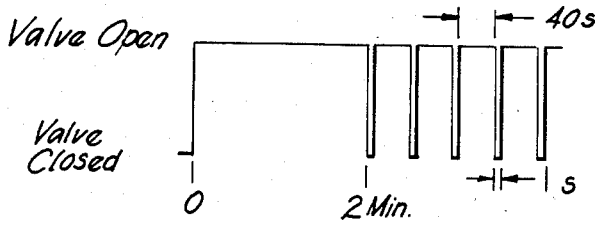

FIGS. 5(*a*) and 5(*b*) illustrates in typical fashion the extent to which the frequency and duty cycle of the output pulses may be varied. FIG. 5(*a*) illustrates the pulses generated at the maximum setting of variable resistor R5. Timer U1 produces a relatively long (2 minute) "ON" pulse and then generates a series of pulses having a period of 110 seconds and a duty cycle of 75 seconds. FIG. 5(*b*) illustrates the series of pulses generated for the minimum setting of variable resistor R5. For the pulses illustrated in FIG. 5(*b*), the period is 41 seconds, and the duty cycle is 40 seconds. The output pulses illustrated in FIGS. 5(*a*) and 5(*b*) correspond to maximum efficiency and minimum efficiency, respectively.

The pulsator circuit shown in FIG. 4 may also be made to operate independent of timer U1 and switch S2 by connecting a second thermostat T1 across the main terminals of switch S2 as indicated in phantom. Thermostat T1 may be set for the absolute minimum temperature desired for the room. When the room temperature drops below the absolute minimum desired temperature, thermostat T1 closes and the gas valve is held in the energized position until the room temperature rises above the setting of T1. Once the temperature of the room exceeds the setting of T1, T1 opens, and the gas valve is controlled in response to timer U1 and switch S2.

To install the pulsator 10 in an existing gas fired furnace installation, plastic moulded housing 12 is suitably mounted on a wall in a room of the building being heated. A convenient location would be adjacent the room thermostat. The wiring 14 is connected to the transformer, room thermostat and gas valve as indicated in FIG. 3. The wiring 14 connects the safety thermostat T1, which is housed in the housing 12 along with the switch S1, timer U1 and electronic solid state switch S2, to the 24 Volt A.C. of the transformer via the output terminal of the room thermostat. The thermostat T1 functions as a safety system to prevent the room ambient temperature dropping too low, e.g. to freezing, in the event of a failure of the Triac S2, the pulse generator U1 or associated circuitry when the pulsator is switched on, i.e. when the switch S1 is in position 2.

It will be appreciated that the two scales 20, 22 indicating side by side the furnace efficiency and the selected pulse duration setting for any selected setting of the control member 24, enables a building occupant to readily choose the most appropriate setting between slower rate of heating at higher furnace efficiency and faster rate of heating at lower furnace efficiency, depending upon the need to increase room temperature more rapidly against economy of gas consumption. This provides a visual indication that the furnace efficiency increases with longer pulse duration.

Also, it will be apparent that with the particular arrangement of the time constant network R4, R5, R6 and C2, by having the middle resistor R5 variable, fixed resistors R4 and R6 determine maximum and minimum values of the pulse duration to ensure that the furnace operates within acceptable cycles.

It will be appreciated that the foregoing invention provides a simple, reliable and effective means for increasing gas furnace efficiency.

The present invention may be embodied in other specific forms without departing from the spirit or essential attributes thereof and, accordingly, reference should be made to the appended claims, rather than to the foregoing specification, as indicating the scope of the invention.

What is claimed is:

1. An electronic gas valve pulsator for a gas fired furnace controlled by a room thermostat, comprising:

a plastic housing adapted to be mounted on a wall of a room, said housing having an opening therein with a manually operable control member extending therethrough and movable therein;

two scales associated with said opening and indicating pulse duration and furnace efficiency, respectively, for any selected setting of said control member;

an electronic timer housed in said housing for generating a series of electrical pulses having a preselected frequency and duty cycle as determined by the setting of said control member relative to said scales;

an electronic solid-state switch mounted in said housing and controlled by said electronic timer, said solid-state switch being connected in series, in use, with a gas valve of said gas fired furnace for alternately energizing and deenergizing said valve in response to said electrical pulses, whereby said valve is in the fully-open position when energized and in the fully-closed position when deenergized;

a time constant network connected to said electronic timer for controlling said electronic timer, said time constant network comprising first, second and third resistors connected in series and in series with a capacitor, said second resistor being connected intermediate said first and third resistors and being adjustable by movement of said control member, and said first and third resistors being fixed in value to predetermine maximum and minimum values of said pre-selected frequency and duty cycle;

a manually operable double pole switch mounted in said housing for separately disabling both said electronic timer and said electronic switch, whereby in use when said manually operable switch disables said electronic timer and said electronic switch, said gas valve will be in the fully-open position when said room thermostat is closed and in the fully-closed position when said room thermostat is open;

control wiring connected to said switch for connection to controls of said furnace;

a rectifier network connected between said double pole switch and said time constant network for supplying said time constant network and said electronic timer with a rectified D.C. voltage when said double pole switch is connected to a supply of A.C. voltage; and a safety thermostat mounted in said housing and connected in a parallel across said electronic switch for energizing said valve independently of said electronic switch when the ambient temperature in the vicinity of said housing drops below a pre-determined minimum value and said manually operable switch has not been operated to disable said electronic timer and said electronic switch, said safety thermostat preventing the ambient temperature of the room from dropping to freezing in the event of a failure of the electronic gas valve pulsator.

2. The electronic gas valve pulsator of claim 1, wherein said electronic timer generates a two minute "ON" pulse followed by a series of shorter pulses having a period of 110 seconds and a duty cycle of 75 seconds at the maximum setting of said variable second resistor, and generates a two minute "ON" pulse followed by a series of shorter pulses having a period of 41 seconds and a duty cycle of 40 seconds at the minimum setting of said variable second resistor.

3. In a gas fired furnace having a room thermostat and an electrically-operated gas valve for controlling the flow of gas to said furnace, a device for pulsating said gas valve between a fully-open position and a fully-closed position when said room thermostat is closed, said device comprising:

a plastic housing adapted to be mounted on a wall of a room adjacent said room thermostat, said housing having an opening therein with a manually operable control member extending therethrough and adjustably movable relative thereto;

an electronic timer disposed in said housing for generating a series of electrical pulses having a preselected frequency and duty cycle as determined by adjustment of said control member relative to said opening;

an electronic solid-state switch mounted in said housing and controlled by said electronic timer, said solid-state switch being connected in series, in use, with said gas valve for alternately energizing and deenergizing said gas valve in response to said electrical pulses, whereby said gas valve is in the fully-open position when energized and in the fully-closed position when deenergized;

a time constant network connected to said electronic timer for controlling said electronic timer, said time constant network comprising first, second and third resistors connected in series and in series with a capacitor, said second resistor being connected intermediate said first and third resistors and being adjustable by movement of said control member relative to said opening, and said first and third resistors being fixed in value to determine maximum and minimum values of said pre-selected frequency and duty cycle;

a rectifier network connected to said time constant network for supplying said time constant network and said electronic timer with a rectified D.C. voltage when said rectifier network is connected to a supply of A.C. voltage; and a safety thermostat mounted in said housing and connected in parallel across said electronic switch for energizing said gas valve independently of said electronic switch when the ambient temperature in said room drops below a pre-determined minimum value to prevent the ambient temperature of the room from dropping to freezing in the event of a failure of said electronic switch to energize said gas valve when said room thermostat is closed.

4. In a gas fired furnace having a room thermostat for mounting on a wall of a room to be heated by said furnace and an electrically-operated gas valve for controlling the flow of gas to said furnace, an electronic gas valve pulsator for pulsating said gas valve between fully-open and fully-closed positions when said room thermostat is closed, said electronic gas valve pulsator comprising:

a plastic housing adapted to be mounted on said wall adjacent said room thermostat, said housing having a rectangular face plate with an elongate opening extending therealong and a manually operable control slide protruding outwardly through and movable along said elongate opening;

two scales associated with said elongate opening and indicating pulse duration and furnace efficiency, respectively, for any selected setting of said control member, said scales extending along said elongate opening on opposite sides thereof;

electronic timer means, housed in said housing, for generating a series of electrical pulses having a pre-selected frequency and duty cycle as determined by the setting of said control member along said elongate opening relative to said scales;

said electronic timer means generating a relatively long initial "ON" pulse followed by a series of shorter equal pulses, and the setting of said slide determining both the period of said shorter pulses and the duty cycle thereof;

an electronic solid state switch mounted in said housing and controlled by said electronic timer means, said solid state switch being connected in series with said gas valve for alternately energizing and deenergizing said valve in response to said electrical pulses, whereby said valve is in the fully-open position when energized and in the fully-closed position when deenergized;

a time constant network connected to said electronic timer means for controlling the latter, said time constant network comprising first, second and third resistors connected in series and in series with a first capacitor, said second resistor being connected intermediate said first and third resistors;

said second resistor being adjustable by movement of said slide along said elongate slot;

said first and third resistors being fixed in value to pre-determine maximum and minimum adjustable values of said pre-selected frequency and duty cycle;

a rectifier network connected across said time constant network for supplying said time constant network and said electronic timer with a rectified D.C. voltage when said rectifier network is connected to a supply of A.C. voltage;

said rectifier network comprising fourth and fifth resistors connected in series, in use, across said supply of A.C. voltage, a second capacitor connected in parallel with said series connected fourth and fifth resistors, and a sixth resistor and a diode connected in series between said fourth resistor and one side of said second capacitor, said fifth resistor and the other side of said capacitor being connected to ground; and a safety thermostat mounted in said housing and connected in parallel across said electronic switch for energizing said gas valve independently of said electronic switch when the ambient temperature in said room drops below a pre-determined minimum value, said safety thermostat preventing the ambient temperature of said room from dropping to freezing in the event of a failure of said electronic switch to energize said gas valve when said room thermostat is closed.

5. The electronic gas valve pulsator of claim 4, wherein:

said electronic solid-state switch comprises a triac having a gate terminal connected to said electronic timer means via a resistor, one side of said triac being connected to ground;

said relatively long initial "ON" pulse has a period of two minutes, and said shorter equal pulses are adjustable between a maximum period of 75 seconds each and a minimum period of 41 seconds each, the duty cycle of the maximum period pulses being 110 seconds and the duty cycle of the minimum period pulses being 40 seconds; and further comprising a manually operable double pole switch mounted in said housing and connected for one pole to disable said electronic timer and the other pole to simultaneously shunt said triac and said safety thermostat for disconnecting said electronic gas valve pulsator.

* * * * *